US011834950B2

(12) United States Patent
Riechers

(10) Patent No.: US 11,834,950 B2
(45) Date of Patent: Dec. 5, 2023

(54) TUNNEL LINING COMPOSED OF AT LEAST TWO CONCRETE ELEMENTS

(71) Applicant: HERRENKNECHT AG, Schwanau (DE)

(72) Inventor: Jorg Riechers, Zell am Harmersbach (DE)

(73) Assignee: Herrenknecht AG, Schwanau (DE)

( * ) Notice: Subject to any disclaimer, the term of this patent is extended or adjusted under 35 U.S.C. 154(b) by 304 days.

(21) Appl. No.: 17/255,766

(22) PCT Filed: Jun. 24, 2019

(86) PCT No.: PCT/EP2019/066630
§ 371 (c)(1),
(2) Date: Jul. 23, 2021

(87) PCT Pub. No.: WO2020/007631
PCT Pub. Date: Jan. 9, 2020

(65) Prior Publication Data

US 2021/0355827 A1 Nov. 18, 2021

(30) Foreign Application Priority Data

Jul. 2, 2018 (EP) ..... 18181230

(51) Int. Cl.
*E21D 11/38* (2006.01)
*E21D 11/08* (2006.01)

(52) U.S. Cl.
CPC ..... *E21D 11/08* (2013.01); *E21D 11/385* (2013.01)

(58) Field of Classification Search
CPC ..... E21D 11/08; E21D 11/385; E21D 11/15; E21D 11/086
See application file for complete search history.

(56) References Cited

U.S. PATENT DOCUMENTS 3,707,846 A 1/1973 Leblond et al.
3,816,370 A 6/1974 Lennox
(Continued)

FOREIGN PATENT DOCUMENTS

DE 3800630 A1 7/1989
DE 3407381 A1 8/1989
(Continued)

*Primary Examiner* — Carib A Oquendo
(74) *Attorney, Agent, or Firm* — Mark Rodgers

(57) ABSTRACT

The invention relates to a tunnel lining composed of at least two concrete elements (10) each having at least one protective element (20) connected to the concrete element, wherein the protective element (20) has a protective portion which has a first side which faces the concrete element (10) and on which there is provided at least one connecting element (17) for producing a retaining connection between the protective portion and the concrete element (10), wherein the protective portion consists of at least one plastic, wherein the protective element (20) has at least one protective element seal (30) which is connected to the protective portion (20), wherein the connection to the protective portion (20) is gas-tight and liquid-tight, wherein a joint (40) is present between the at least two concrete elements (10) arranged to form the tunnel lining (300), wherein the joint (40) is sealed in a gas-tight and liquid-tight manner with respect to the tunnel interior (100) by at least one protective element seal (30) having a sealing action (first sealing action), and wherein the tunnel lining (300) is provided with drainage (C) into the tunnel interior (100).

15 Claims, 3 Drawing Sheets

(56) References Cited

U.S. PATENT DOCUMENTS

Figure 1:
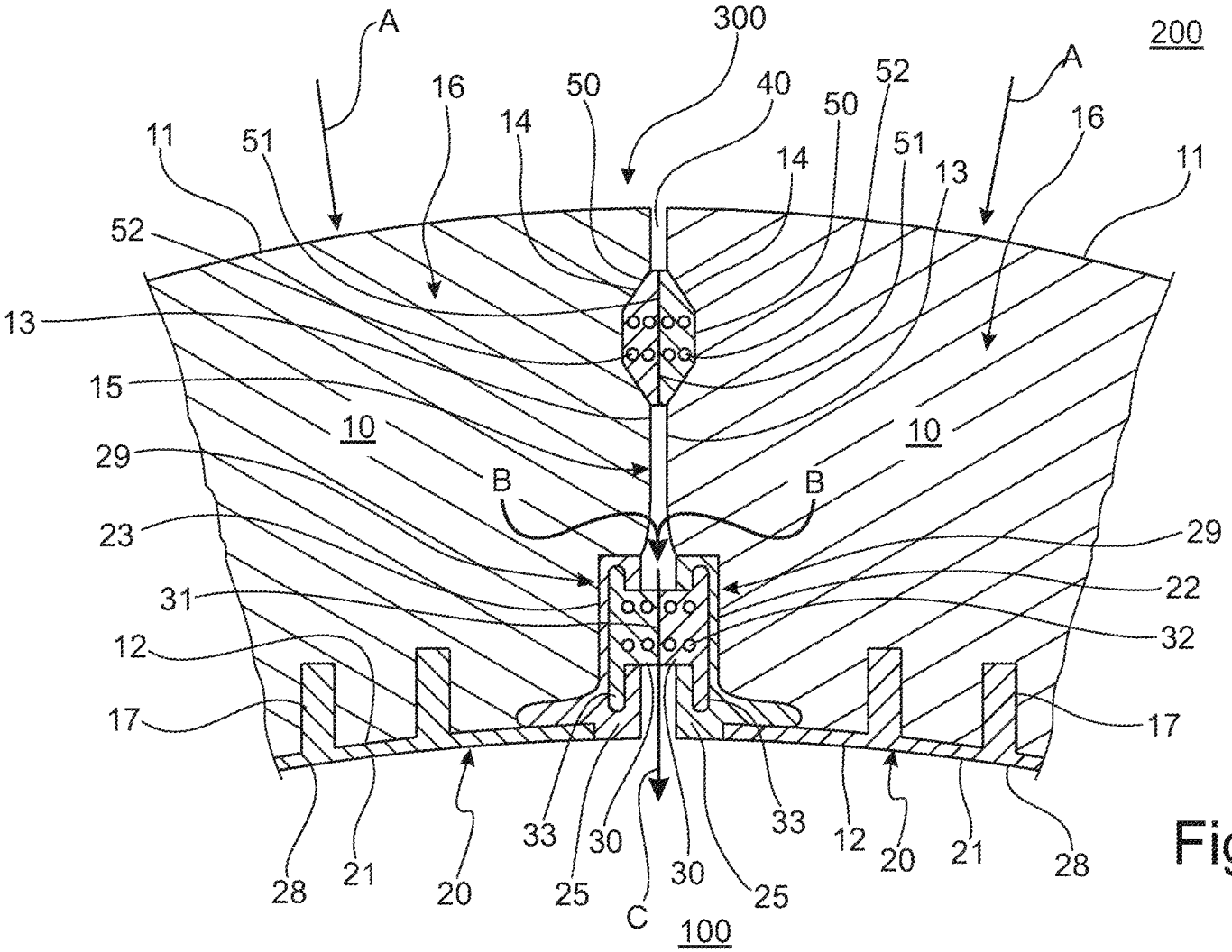

| | | | | |
|---|---|---|---|---|
| 5,439,319 | A * | 8/1995 | Flanagan | E21D 11/385 405/152 |
| 5,470,178 | A * | 11/1995 | Weholt | E21F 16/02 405/152 |
| 6,328,501 | B1 | 12/2001 | Gimbert | |
| 2005/0095066 | A1* | 5/2005 | Warren | E21D 11/38 405/150.1 |
| 2012/0301224 | A1* | 11/2012 | Peters | B28B 21/563 405/152 |
| 2014/0193204 | A1* | 7/2014 | Weber | E21D 11/08 405/152 |

FOREIGN PATENT DOCUMENTS

| | | | |
|---|---|---|---|
| DE | 102012008258 | A1 | 7/2012 |
| GB | 2093505 | B | 9/1982 |
| JP | 2004132002 | B | 4/2004 |
| WO | 2005/024183 | A1 | 3/2005 |
| WO | 2011/085734 | A1 | 7/2011 |
| WO | 2015/139807 | A2 | 9/2015 |
| WO | 2017/008913 | A1 | 1/2017 |

* cited by examiner

TUNNEL LINING COMPOSED OF AT LEAST TWO CONCRETE ELEMENTS

The invention relates to a tunnel lining composed of at least two concrete elements each having at least one protective element connected to the concrete element, wherein the protective element has a protective portion which has a first side which faces the concrete element and on which there is provided at least one connecting element for producing a retaining connection between the protective portion and the concrete element, wherein the protective portion consists of at least one plastic, wherein the protective element has at least one protective element seal which is connected to the protective portion, wherein the connection to the protective portion is gas-tight and liquid-tight, wherein a joint is present between the at least two concrete elements arranged to form the tunnel lining, wherein the joint is sealed in a gas-tight and liquid-tight manner with respect to the tunnel interior by at least one protective element seal having a sealing action (first sealing action), and wherein the tunnel lining is provided with drainage into the tunnel interior.

Tunnel linings of this type with concrete elements having protective elements are known, inter alia, from WO 2005/024183 A1, WO 2011/085734 A1, WO 2015/139807 A2 and from WO 2017/008913 A1. An alternative embodiment is disclosed in JP 2004132002.

The concrete elements used here are also referred to as "segments" in technical terminology and are used e.g. as constituent parts of the tunnel lining in the case of mechanized shield tunneling. Such a tunnel lining is used for example in conjunction with tunnel boring machines which comprise a boring head, behind which a cylindrical shield with a shield skin and a shield tail is arranged. The shield has a smaller external diameter than the boring head, and therefore there is no direct contact between the tunnel wall and the shield. When the tunnel boring machine has advanced a certain distance, the concrete elements are positioned on the shield edge in the shield tail. They are pressed, counter to the advancement direction, onto the adjacent, most recently attached concrete elements and are optionally connected thereto. A plurality of concrete elements together form a tunnel lining in the form of a ring over the entire circumference of the tunnel. The tunnel lining is then gradually formed ring by ring.

The gap between a ring and the tunnel wall is optionally filled with mortar, e.g. in order to prevent subsidence. For this purpose, WO 2005/0241863 A1 for example discloses an injection hole in the center of the concrete element that is configured as a hole which connects the outer surface of the concrete element to the inner surface of the concrete element. After the individual concrete element is positioned and connected to its adjacent concrete elements, mortar is injected between the concrete element and the tunnel wall via the injection hole. In this way, subsidence in the ground which surrounds the concrete elements is prevented. In addition, the concrete element can be moved and positioned by means of the injection hole by way of a suitable tool being engaged into it.

This type of tunnel lining is also used, inter alia, for the construction of wastewater lines, in particular of relatively large collecting lines. In this respect, as is also the case with other possible intended uses, the tightness of the cladding of the tunnel is subject to stringent requirements. The inner side of the segments is sealed by a cladding so that it is not possible for any gases rising up from the wastewater or possibly even the wastewater itself to pass into the concrete via the tunnel walls and damage said concrete (corrosion).

In the case of a tunnel which is clad with concrete elements according to WO 2005/024183 A1, WO 2011/085734 A1, WO 2015/139807 A2 or WO 2017/008913 A1, the protective layer comprising protective elements protects the concrete of the concrete elements against the action of aggressive (e.g. corrosive) gases or liquids. Together with seals, the protective elements of the concrete elements of the cladding thus seal the tunnel lining and/or the concrete elements thereof from the inside. The concrete element is produced in a prefabricated manner with the protective element, as a result of which sealing of the cladding as a separate working step during tunnel construction, for example the welding of the joints between the protective elements/protective layers of adjacent concrete elements, is dispensed with.

WO 2005/024183 A1, WO 2011/085734 A1, WO 2015/139807 A2, WO 2017/008913 A1 and likewise JP2004132002 disclose that the segments used for the tunnel lining are produced beforehand, and that a cladding is already arranged on the inner side of the segments during the production of the segments, this cladding, when the individual segments are in the state in which they are assembled to form rings, sealing the tunnel wall against water, wastewater and gases.

Here, provided on the concrete element is a protective layer which covers an inner surface of the segment that lies opposite a convex outer surface. Said protective layer consists of glass fiber-reinforced plastic or polyethylene (PE) according to WO 2005/024183 A1, of polydicyclopentadiene (pDCPD) according to WO 2011/085734 A1, of a mixture of PE and pDCPD according to WO 2015/139807 A2, or of a synthetic resin according to JP2004132002 and here, in particular, of polyethylene (PE), polypropylene (PP), PVC, polyester or vinyl ester, and is anchored fixedly in the concrete by means of mechanical anchoring, with the result that an inseparable connection of the protective layer to the concrete is produced. Here, the protective layer is designed such that only the inner side of the segment element is covered (JP2004132002) or else side faces of the concrete element are partially likewise enclosed (WO 2005/024183 A1, WO 2011/085734 A1, WO 2015/139807 A2). A selection of materials from the options mentioned above is also provided for the protective elements according to the invention.

According to WO 2005/024183 A1, WO 2011/085734 A1, WO 2015/139807 A2 and WO 2017/008913 A1, a seal which projects beyond the protective layer is subsequently provided on the side face. The seal is produced from an elastic material, with the result that the joints between the adjacent concrete elements are closed by way of the seal during assembly of the individual segments to form the tunnel lining. A protective element seal of this type having the function described above is also provided for the protective elements according to the invention. As an alternative, the joints can be closed by welding the individual protective layers which are provided on the inner side of the concrete elements.

According to WO 2005/024183 A1, the concrete element itself is produced by means of a formwork. A protective layer is placed into the formwork onto the formwork bottom. Furthermore, if provided, protective layer elements are likewise placed onto the side walls of the formwork. Furthermore, if provided, the formwork has a cutout, into which the seal is inserted. Subsequently, the concrete is introduced into the formwork in conjunction with reinforcement. After the concrete has hardened, the segment is used as a tunnel lining.

It has been found in practice, according to WO 2005/024183 A1, that leakages can occur in the transition between the protective layer and the seal if sufficient care has not been taken during the production of the concrete element, in respect of inserting the seal into the formwork and/or in respect of arranging the seal in relation to the protective layer. To counteract this, WO 2011/085734 A1 proposes that the protective element is produced from an injection-moldable plastic, and that a one-piece and gas-tight connection is provided between the seal and the protective element by the seal being connected to the protective element during the production of said protective element by injection molding around same. In WO 2015/139807 A2, some of the PDCPD of the protective element is replaced by at least one planar PE element. This is also provided for the concrete elements according to the invention and/or their protective elements.

If, for example, there is groundwater in the region of the tunnel, there is the risk that said groundwater is under pressure or a corresponding pressure arises according to the depth of the tunnel. If there are cracks in the concrete and/or the groundwater penetrates through the concrete, said groundwater prevails on the inner side of the protective layer/the protective elements, with the result that said protective layer/said protective element is pressurized and has to be correspondingly dimensioned in order to counteract a failure of the protective layer.

This occurred, in particular, in the case of tunnels with segments according to WO 2005/024183 A1, in which the anchorages of the protective element detached from the concrete. To counteract this, WO 2011/085734 A1 provided different dimensioning of the anchors. This is secure, but possibly leads to increased outlay during the production of the protective elements and/or the finished concrete elements.

If the protective elements are welded to one another, which is usually done manually, a corresponding quality of the welded seams has to be ensured. However, detachments can also occur here.

In the case of a double-shell construction, in which an inner shell is applied to the segments on site, or else in the case of welded protective elements, it is possibly the case that that not all of the ring is cladded with a protective layer, but rather the protective layer and/or the welding of the protective layer is cut out in the bed region, in that region which does not dry out. The prevailing water can then flow out toward the bed on that side of the protective elements which faces the concrete elements, and can then enter the tunnel there and flow out via said tunnel. This is possible if said region does not dry out, and therefore no corrosion of the concrete owing to gases is produced. Such a construction is not possible if the wastewater per se must not be diluted or if the wastewater per se is already so aggressive that the concrete is adversely affected.

WO 2017/008913 A1 provides an alternative solution in the case of pressurized water. In this case, the protective portion has at least one drainage element, for example an opening in the protective element or else a sleeve/an erector dowel with openings, optionally with a closure element, through which drainage element a liquid can pass from the first side of the protective portion toward that opposite side of the protective portion that faces away from the concrete element. Instead of strengthening the anchorage of the protective element with respect to the concrete element, the prevailing groundwater is discharged in a targeted manner through the protective element, and detachment caused by pressure is thus prevented. Here, however, the gas-tightness of the protective element has to be ensured despite the drainage element.

According to the invention, an alternative possibility of draining the concrete elements is proposed. In this respect, the solution according to the invention provides that at least one concrete element has at least one concrete element seal which is arranged separately from the protective element and which has a sealing action (second sealing action) which seals the joint in a gas- and liquid-tight manner with respect to the rock, that the drainage occurs through the joint between the at least two concrete elements, and that the protective element seal has a lower sealing action than the concrete element seal (first sealing action<second sealing action).

It has surprisingly been found that, in this way, a sufficient possibility of drainage as protection against protective elements breaking away from the concrete elements can be provided. At the same time, this makes it possible to provide sufficient protection against corrosion if openings in the protective elements are not possible.

A further teaching of the invention provides that water permeability from the concrete element into the joint exists between the protective element seal and the concrete element seal. A further teaching of the invention provides that the concrete element seal is provided at a distance from the protective element seal on the protective element. This enables safe drainage from the concrete element in a simple manner.

A further teaching of the invention provides that the concrete element seal is arranged in a depression in the concrete element. This enables a secure arrangement of the concrete element seal on the concrete element in a simple manner.

A further teaching of the invention provides that the protective portion has at least one bottom portion or has at least one bottom portion and at least one wall portion. This provides an adequate protective element in a simple manner.

A further teaching of the invention provides that the connecting element is an anchor structure, a honeycomb structure, a crosspiece, a pin and/or a surface element having openings. A further teaching of the invention provides that the connecting element is projections which preferably consist of the same plastic as the bottom portion and/or wall portion. It is furthermore advantageous that the protective portion is connected in one piece to the at least one connecting element, the one-piece connection preferably being produced by injection molding of the plastic. Surface elements, in particular, such as honeycomb structures or surface portions having through-openings, make it possible to anchor the protective element particularly well to the concrete element over the entire surface area of the protective element. The additional provision of pins or the like, which possibly reach further into the concrete of the concrete element, makes it possible to achieve an enhanced increase in the retaining force at certain points.

A further teaching of the invention provides that the gas-tight and fluid-tight connection between the protective portion and the protective element seal is injection molded. A further teaching of the invention provides that the protective element seal with the protective portion is produced by injection molding with at least one plastic. This makes it possible to restrict the injection molding substantially to the direct connection of the bottom portion to the protective element seal. By virtue of connecting the seal and the connecting elements to the protective portion, a liquid-tight and gas-tight connection is produced in a particularly simple manner. The injection molding makes it possible to ensure that the protective elements are produced with consistently high quality, and therefore the protective action of the protective element with respect to the finished concrete element is particularly high and of consistently high quality, irrespective of the production process of the concrete element. In this respect, the protective element is molded such that, with respect to the seal, the injection-molding material encloses the sealing material at least on three sides.

Injection molding is understood here as meaning all methods which can be included by injection molding, that is to say methods in which one or more thermoplastics/thermosets/elastomers, for example as polymers or else monomers, are introduced directly into a mold on their own, individually, one after another or at the same time (for example overmolding or multi-component injection molding), or in which monomers are processed which only become polymers in the injection mold (for example reaction overmolding).

A further teaching of the invention provides that the plastic is a polydicyclopentadiene (pDCPD), preferably with high temperature resistance, a resin, into which preferably glass fibers are incorporated, or a thermoplastic, preferably PE. Said plastic makes it possible to achieve a high production speed by virtue of the rapid processing properties. At the same time, there is a particularly high resistance during use.

A further teaching of the invention provides that the at least two concrete elements are gas-tight with respect to the tunnel interior owing to the provision of the respectively one protective element. In this way, a high corrosion resistance of the tunnel lining is achieved in a simple manner.

A further teaching of the invention provides that the tunnel lining is built up in two parts with an inner concrete element, on which the protective element is arranged, and an outer concrete element, on which the concrete element seal is arranged. It is advantageous in this case that a joint through which a liquid can flow is provided, preferably concentrically, between the concrete elements. A further teaching of the invention provides in this case that the joint is filled with a liquid-permeable filler material. It has been found that, in this way, should a two-part tunnel lining be necessary, a simple drainage possibility is provided in a particularly simple manner, while at the same time a high corrosion resistance is achieved in a simple manner.

A further teaching of the invention provides that, for example, the bottom portion and/or wall portion consists substantially of a film, a plate or a sheet, which preferably is connected to connecting elements, and/or of a further plastic, for example PE. These are particularly cost-effective plastics. Components made from said plastics, such as for example plates, sheets or films, can be produced directly on site in a decentralized manner, with the result that considerable transport outlay and possibly also storage outlay for the finished products are dispensed with.

In addition, a further teaching of the invention provides that additional drainage elements can be provided in the planar portions of the protective elements. This is advantageous if the drainage according to the invention should be regarded as not sufficient when dimensioning the tunnel lining.

In this context, a further teaching of the invention provides that, furthermore, a roof element is also provided, and therefore a hollow body is created into which the concrete and, possibly already during the injection molding, reinforcement are then subsequently introduced. This is advantageous in particular if the concrete element also has to be protected on its outer sides against aggressive bodies of water in the rock.

A further teaching of the invention provides that the sealing action of the material of the protective element seal and/or of the concrete element seal remains unchanged in contact with liquids. It has been found that sealing materials which swell or shrink in contact with liquid do not sufficiently secure sealing, in particular against gas or liquids emerging from the tunnel interior that lead to concrete corrosion and/or against liquids prevailing from the surrounding rock, if at the same time it is intended for drainage to take place according to the invention.

A further teaching of the invention provides that the protective element is provided on that side of the concrete element which faces the interior space of the tunnel. This makes it possible in a simple manner to allow liquids that prevail in the surrounding rock to enter the tunnel and also to prevent gases or liquids which are located in the tunnel interior from emerging into the concrete element and at the same time to enable drainage according to the invention.

A further teaching of the invention provides that the protective element seal is arranged in the joint between that end of the joint which faces the interior space and the concrete element seal. This permits drainage through the seal in a particularly simple manner.

Furthermore, the invention correspondingly provides a method for draining the tunnel lining described above, wherein a liquid which prevails in the rock surrounding the tunnel lining passes through the concrete element in the case of damage to it and arrives at the protective element, and is discharged through the joint between the concrete elements and through the protective element seals located in the joint into the tunnel interior. This permits drainage of the tunnel lining in a particularly simple manner, without the sealing of the lining by the protective element against the entry of gas/liquid from the tunnel interior being nullified.

It is advantageous in this case that the joint is sealed against the entry of liquid from the rock by virtue of the concrete element seals located in the joint. Here, at the same time, the seal against the uncontrolled entry of liquid from the rock into the interior of the tunnel is avoided in combination in a simple manner.

Figure 2:
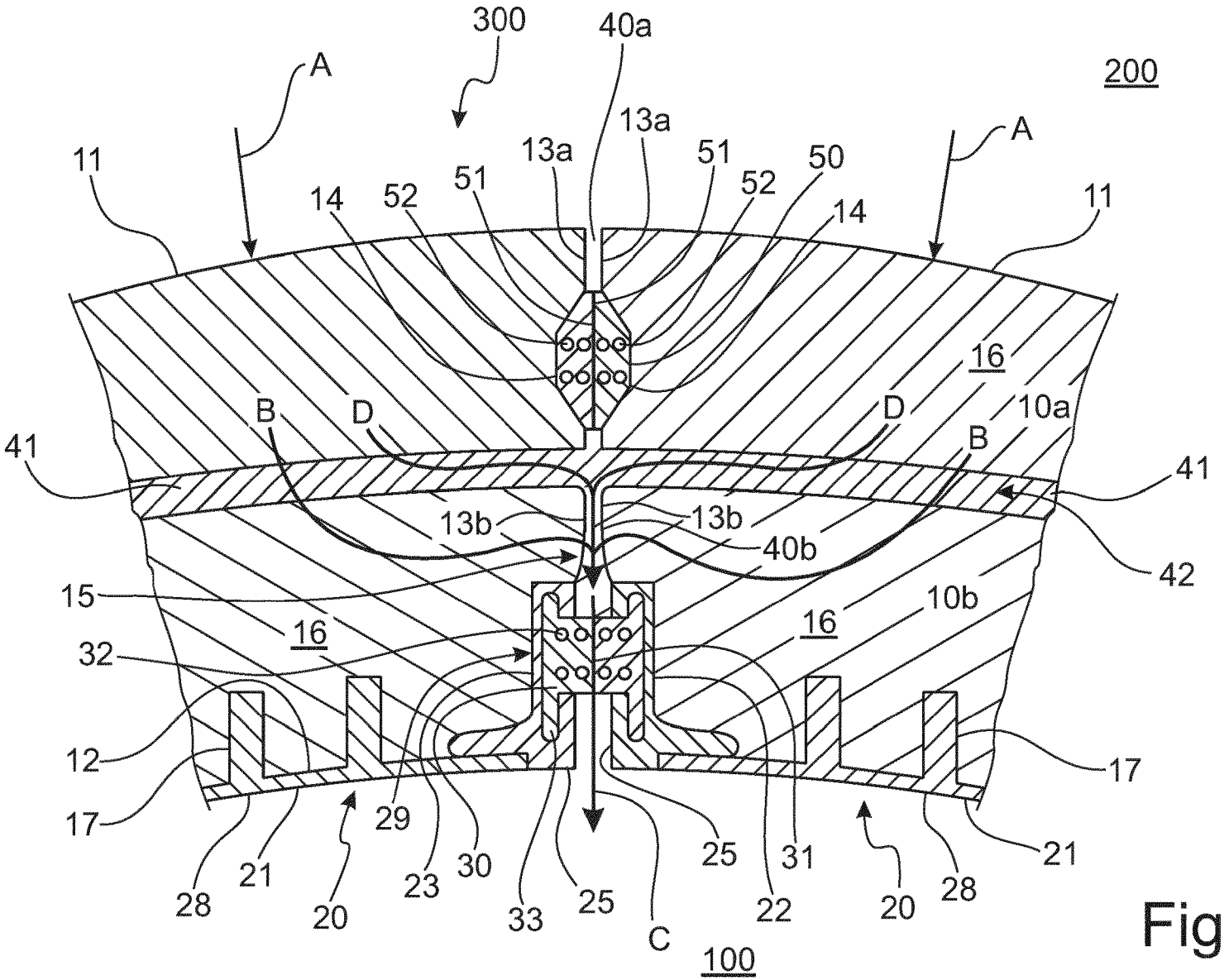

The invention will be explained in more detail below with reference to drawings, in which:

FIG. 1 shows a sectional illustration of a first embodiment of a tunnel lining according to the invention with concrete elements having a protective element, FIG. 2 shows a sectional illustration of a second embodiment of a tunnel lining according to the invention with concrete elements having a protective element, and FIGS. 3*a*-3*d* show basic diagrams in sectional views of alternative embodiments of the protective element.

In a first embodiment of a tunnel lining 300 according to the invention, a lining ring composed of concrete elements 10 (segments) (FIG. 1) is provided. The concrete element has a convex top side 11 and a bottom side 12 arranged opposite thereto (concealed by a protective element 20 in FIG. 1). The protective element 20 is arranged on the bottom side 12 of the concrete element 10.

The concrete element 10 has depressions 14 on its wall portions 13 which are, for example, not covered by the protective element 20. Concrete element seals 50 are arranged in the depressions 14. Said concrete element seals have a sealing face 51, which comes into contact either with another wall portion 13 or another sealing face 51 of a concrete element seal 50 when the individual concrete elements 10 are being assembled. The concrete element seal 50 has, for example, chambers 52 in the interior. When the concrete elements 10 are being assembled, the elastic plastic of the concrete element seal 50 is deformed and the chambers 52 are compressed. Retaining projections (not illustrated) which engage into the concrete 16 after it has been cast, can optionally be arranged so as to lie opposite the sealing face 51.

In this embodiment, the protective element 20 has a bottom portion 21 and wall portions 22, 23. A receiving region 29 in which a protective element seal 30 is arranged is arranged on these wall portions 22, 23. The seal 30 and the protective element 20 are connected for example by injection molding.

A spacing 15, which is not covered by the protective element 20, is provided between the protective element seal 30 and the concrete element seal 50.

As an alternative, the concrete element 10 can also have only a protective element with a bottom portion 21 (not illustrated), on which protective element the protective element seal 30 is arranged in a gas- and liquid-tight manner, for example by injection molding.

The protective element 20 has a bottom portion 21, on the outer sides of which wall portions 22, 23 are arranged substantially at right angles or else in any desired other arrangement. In order to produce a retaining connection between the protective element 20 and the concrete element 10, the inner side of the bottom portion 21 has retaining elements 17, for example pins. As an alternative that is not illustrated, it can also be the case that crosspieces are arranged parallel to the one outer wall and crosspieces are arranged with respect to the outer wall which is arranged at a right angle to said outer wall. The crosspieces can, for example, be provided with openings through which concrete 16 can pass, the concrete therefore producing a connection after hardening that retains particularly well.

The bottom portion 21 has a second planar portion 28 which can consist, for example, of a PE film. This second portion can extend over the entire bottom portion 21 or only parts thereof. Said second portion is preferably connected by means of injection molding to the rest of the protective element 20, in particular the first portion 25, which can form part or all of the wall portion 22.

The protective element seal 30 consists of an elastic plastic. The seal 30 has a sealing face 31 which comes into contact either with another concrete surface or another sealing face 31 of a protective element seal 30 when the individual concrete elements are being assembled. The protective element seal 30 has chambers 32 in the interior. When the concrete elements 10 are being assembled, the elastic plastic of the protective element seal 30 is deformed and the chambers 32 are compressed. Retaining projections 33 which engage into the plastic of the wall portions 22, 23 of the protective element 20 are arranged so as to lie opposite the sealing face 31. Said retaining projections and the side walls of the protective element seal 30 that lie close to them are connected during the injection molding to the plastic of the protective element and/or are encapsulated by said plastic in a gas-tight manner. According to the invention, the protective element seal 30 has a sealing action which is smaller than the sealing action of the concrete element seal 50 but sufficiently great that no gases or liquids can pass out of the tunnel interior 100 through the protective element seal 30 and for example enter the joint and then come into contact with the concrete 16 there.

A protective element 20, as illustrated in FIG. 1, can be produced for example by injection molding. Alternative embodiments are illustrated in FIGS. 1 and 3*a* to 3*d*.

Figure 3A:
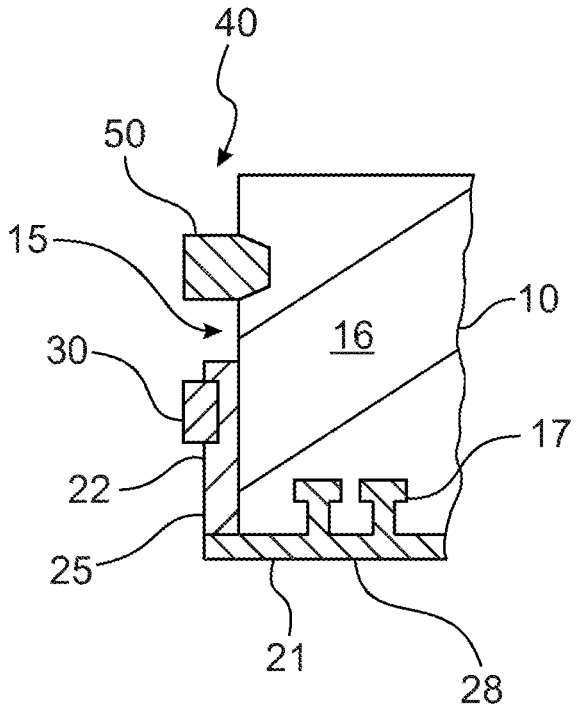
Figure 3B:
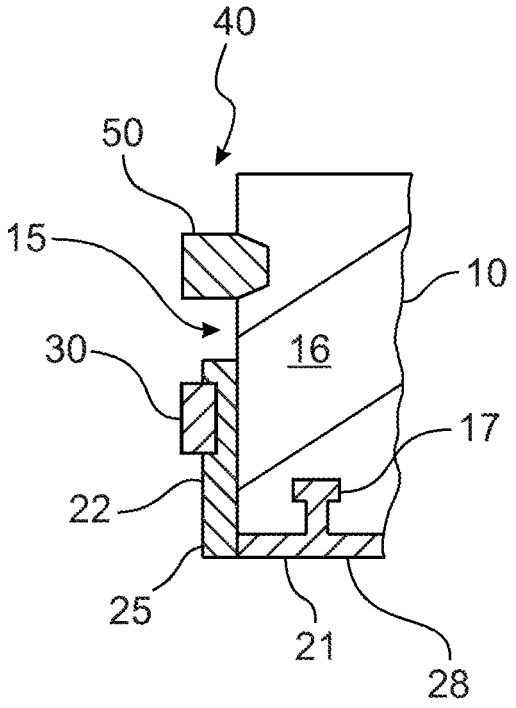
Figure 3C:
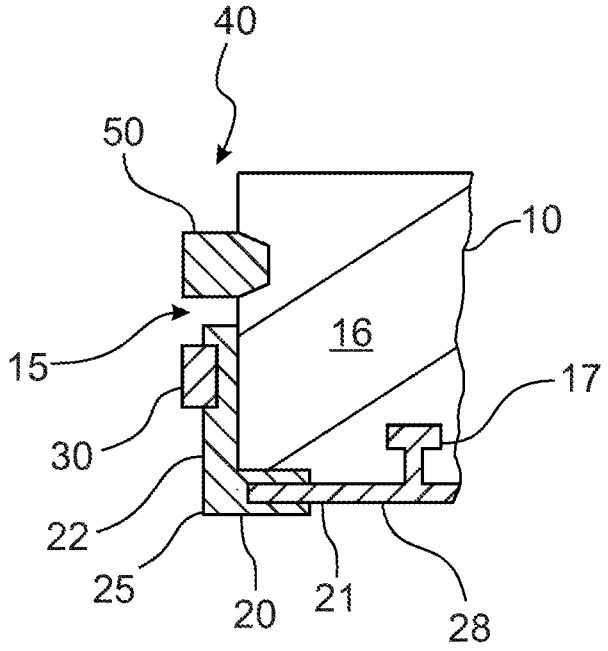
Figure 3D:
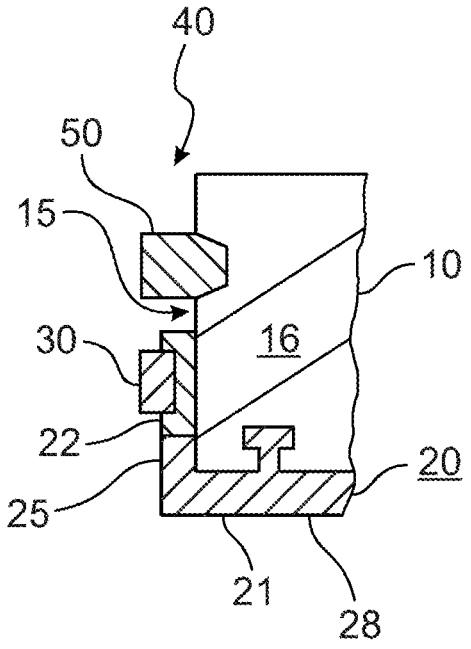

FIGS. 3*a* to 3*d* show alternative embodiments of the protective element 20 with regard to the fact that the protective element 20 or the bottom portion and/or the wall portion are produced at least partially a planar portion 28 from prefabricated semifinished products, such as crosspieces with projections arranged on them. In this respect, FIGS. 3*a* to 3*d* show a variety of exemplary ways of connecting the second portion 28 to the first portion 25, which has been produced for example in a injection-molding process. This connection can take place in the manner of a butt joint (FIGS. 3*a*, 3*d* and 3*c*) or the second portion 28 is engaged around by the first portion 25 on one side (not shown) or on both sides (FIG. 3*d*). In FIG. 3*b*, the planar element forming the second portion 28 is provided not only as a constituent part of the bottom portion 21 but also as a wall portion 22, 23. The connection in the manner of a butt joint, as illustrated in FIGS. 3*a*, 3*d* and 3*c*, has surprisingly proven to be sufficient, in particular in the case of the connection of PE as a planar element and pDCPD as an injection-moldable plastic of the first portion 25. It is also possible, depending on the requirement made of the protective element, to provide a plurality of planar portions which are possibly made from different materials, which planar portions are then connected to one another via a plurality of first portions 25 by way of the injection-moldable plastic or plurality of different injection-moldable plastics. This applies to the bottom portion 21, the wall portion 22, 23 and also the roof portions.

The possibility of providing further drainage openings on the first and/or second portions 25, 28 and providing drainage elements in said drainage openings is not illustrated.

The tunnel lining 300 according to the invention is formed by assembling the concrete elements 10 to form a ring on the rock 200 and arranging a plurality of rings to form a lining. By virtue of the assembly, joints 40 are present between the concrete elements 10. These joints are closed by the concrete element seals 50 on the rock side such that, since the sealing action thereof is greater than the groundwater pressure, no groundwater or other prevailing liquids can enter the joints 40 behind the concrete element seal 50.

Prevailing at the top side 11 of the concrete element 10, in the rock 200, is confined groundwater or groundwater which is under pressure depending on the depth of the tunnel in the ground. Said groundwater acts on the tunnel lining 300 according to the invention in the direction of the arrow A. The concrete element seal 50 is designed here such that its sealing action prevents groundwater from being able to penetrate into the joint 40 behind the concrete element seal 50. If, in the event of damage, cracks are present in the concrete 16 and/or, in the event of damage, the groundwater penetrates through the concrete 16, said groundwater prevails possibly at the bottom side 12 of the concrete element 10 on the inner side of the protective element 20. In this respect, the groundwater can move between the protective element 20 and the concrete element 10 and, depending on the design, passes in the direction of the arrow B through the spacing 15 not covered by the protective element 20 and through it passes into the joint 40, and arrives at the rear side of the protective element seal 30. Reaching the inner side of the protective element 20 is, however, not necessary. The water can also pass directly in the direction of the arrow B into the joint 40 and arrive at the rear side of the protective element seal 30.

Since, according to the invention, the sealing action of the protective element seal is smaller than the prevailing groundwater pressure/liquid pressure, the water/the liquid passes through the protective element seal 30 in the direction of the arrow C and passes into the tunnel interior space 100.

In a first embodiment of a tunnel lining 300 according to the invention, two concentrically built-up lining rings composed of concrete elements 10*a*, 10*b* (segments) (FIG. 2) are provided. The first lining ring is composed of the concrete elements 10*a*. Said concrete elements have a depression 14, in which a concrete element seal 50 is arranged, on their wall portions 13*a*. Joints 40*a* are present between the concrete elements 10*a*. The second lining ring is subsequently constructed, either after completion of the construction of the first lining ring or merely with a time delay, from concrete elements 10*b* which have on their bottom side 12 protective elements 20 having a protective element seal 30 as described above. Joints 40*b* are present between the concrete elements 10*b*.

After the assembly, provided between the concrete elements 10*a* and 10*b* is a concentric joint 41 which is filled with a filler material 42, preferably in a water-permeable manner.

The drainage takes place likewise as described above. There is merely one further possibility for the groundwater/the liquid to flow in the direction of the arrow D in the joint 41 through the filler material 42 to the joint 40*b*.

LIST OF REFERENCE SIGNS

10 Concrete element
10*a* Outer concrete element
10*b* Inner concrete element
11 Top side
12 Bottom side
13 Wall portion
13*a* Outer wall portion
13*b* Inner wall portion
14 Depression
15 Spacing
16 Concrete
17 Retaining element
20 Protective element
21 Bottom portion
22 Wall portion
23 Wall portion
25 First portion
28 Second portion
29 Receiving region
30 Protective element seal
31 Sealing surface
32 Chamber
33 Retaining projection
40 Joint
40*a* Outer joint part
40*b* Inner joint part
41 Joint
42 Filler material
50 Concrete element seal
51 Sealing surface
52 Chamber
100 Tunnel interior
200 Rock
300 Tunnel lining
A Prevailing groundwater
B Direction of flow in the concrete element
C Direction of outflow into the tunnel
D Direction of flow in the joint 41

The invention claimed is:

1. A tunnel lining comprising:

at least two concrete elements each having at least one protective element connected to the concrete elements, wherein the protective element has a protective portion which has a first side which faces the concrete element and on which there is provided at least one connecting element for producing a retaining connection between the protective portion and the concrete element, wherein the protective portion consists of at least one plastic, wherein the protective element has at least one protective element seal which is connected to the protective portion, wherein the connection to the protective portion is gas-tight and liquid-tight, wherein a joint is present between the at least two concrete elements arranged to form the tunnel lining, wherein the joint is sealed in a gastight and liquid-tight manner with respect to a tunnel interior by at least one protective element seal having a first sealing action, through which the tunnel lining is provided with drainage into the tunnel interior;

wherein;

the concrete elements have at least one concrete element seal that is arranged separately from the protective element and which has a second sealing action which seals the joint in a gas- and liquid-tight manner with respect to a tunnel exterior, wherein the drainage occurs through the joint between the at least two concrete elements, and the protective element seal first sealing action is less than the concrete element seal second sealing action.

2. The tunnel lining as claimed in claim 1, wherein water permeability from the concrete element into the joint exists between the protective element seal and the concrete element seal.

3. The tunnel lining as claimed in claim 1, wherein the concrete element seal is provided at a distance from the protective element seal on the protective element.

4. The tunnel lining as claimed in claim 1, wherein the concrete element seal is arranged in a depression in the concrete element.

5. The tunnel lining as claimed in claim 1, wherein the protective portion has at least one of a bottom portion or a bottom portion and at least one wall portion.

6. The tunnel lining as claimed in claim 1, wherein the gas-tight and liquid-tight connection between the protective portion and the protective element seal is injection molded.

7. The tunnel lining as claimed in claim 1, wherein the plastic is one of a polydicyclopentadiene (pDCPD) with high temperature resistance, a resin, into which glass fibers are incorporated, or a thermoplastic, including PE.

8. The tunnel lining as claimed in claim 1, wherein the tunnel lining is built up in two parts with an inner concrete element on which the protective element is arranged, and an outer concrete element, on which the concrete element seal is arranged.

9. The tunnel lining as claimed in claim 8, wherein a joint through which a liquid can flow is provided between the concrete elements.

10. The tunnel lining as claimed in claim 9, wherein the joint is filled with a liquid permeable filler material.

11. The tunnel lining as claimed in claim 1, wherein at least one of the sealing action of the material of the protective element seal or of the concrete element seal remains unchanged in contact with liquids.

12. The tunnel lining as claimed in claim 1, wherein the protective element is provided on that side of the concrete element which faces the interior space of the tunnel.

13. The tunnel lining as claimed in claim 1, wherein the protective element seal is arranged in the joint between that end of the joint which faces the interior space and the concrete element seal.

14. A method for draining a tunnel lining as claimed in claim 1 comprising draining a liquid which prevails in the rock surrounding the tunnel lining through the concrete element in the case of damage whereby the liquid arrives at the protective element, and discharging the liquid through the joint between the concrete elements and through the protective element seals
located in the joint into the tunnel interior.

15. The method as claimed in claim 14, wherein the joint is sealed against the entry
of liquid from the rock by virtue of the concrete element seals located in the joint.

* * * * *